US011782388B2

(12) United States Patent
Halter

(10) Patent No.: US 11,782,388 B2
(45) Date of Patent: Oct. 10, 2023

(54) DEVICE FOR COUPLING TWO HOROLOGICAL OSCILLATORS

(71) Applicant: Vianney Halter, Pontarlier (FR)

(72) Inventor: Vianney Halter, Pontarlier (FR)

(73) Assignee: Vianney Halter, Pontarlier (FR)

( * ) Notice: Subject to any disclaimer, the term of this patent is extended or adjusted under 35 U.S.C. 154(b) by 465 days.

(21) Appl. No.: 16/823,388

(22) Filed: Mar. 19, 2020

(65) Prior Publication Data

US 2020/0319596 A1 Oct. 8, 2020

(30) Foreign Application Priority Data

Apr. 2, 2019 (FR) ..... 1903503

(51) Int. Cl.
*G04B 17/06* (2006.01)
*G04B 15/14* (2006.01)

(52) U.S. Cl.
CPC ..... *G04B 17/06* (2013.01); *G04B 15/14* (2013.01)

(58) Field of Classification Search
CPC ..... G04B 17/06; G04B 15/14; G04B 17/32
USPC ..... 368/127
See application file for complete search history.

(56) References Cited

U.S. PATENT DOCUMENTS

2010/0002548 A1* 1/2010 Hessler ..... G04B 17/20 368/129
2015/0131413 A1* 5/2015 Helfer ..... G04C 3/047 368/80
2015/0138933 A1* 5/2015 Behrend ..... G04B 17/06 368/175
2016/0306324 A1* 10/2016 Sarchi ..... G04B 17/066
2017/0176939 A1 6/2017 Sarchi et al.

FOREIGN PATENT DOCUMENTS

| | | | | |
|---|---|---|---|---|
| CH | 702294 A1 | | 5/2011 | |
| CH | 710935 A2 | * | 10/2016 | ..... G04B 17/06 |
| CH | 710935 A2 | | 10/2016 | |
| CH | 710979 A2 | | 10/2016 | |
| CH | 712100 A2 | * | 8/2017 | |
| CH | 712101 A2 | * | 8/2017 | |
| CN | 202794857 U | * | 3/2013 | |
| EP | 3182216 A1 | | 6/2017 | |
| WO | 2011058157 A1 | | 5/2011 | |

OTHER PUBLICATIONS

Preliminary Search Report of FR 1903503 dated Dec. 6, 2019.
Search Report and Written Opinion for FR2001889, dated Oct. 20, 2020.

* cited by examiner

*Primary Examiner* — Edwin A. Leon
*Assistant Examiner* — Kevin Andrew Johnston
(74) *Attorney, Agent, or Firm* — Renner, Kenner; Zach Boehnlein

(57) ABSTRACT

Horological device (100) comprising two oscillators (1*a,b*) with rotating and spiral (12*a,b*) balance wheels (11*a,b*), coupled for their synchronization. The oscillators (1*a,b*) are identical and their axles (22*a,b*) are parallel. The spirals (12*a,b*) are connected to a shared stud (13) by a link in the same direction but in the opposite direction, the stud being fixed to the rest of the horological movement.

4 Claims, 15 Drawing Sheets

[Fig. 1]
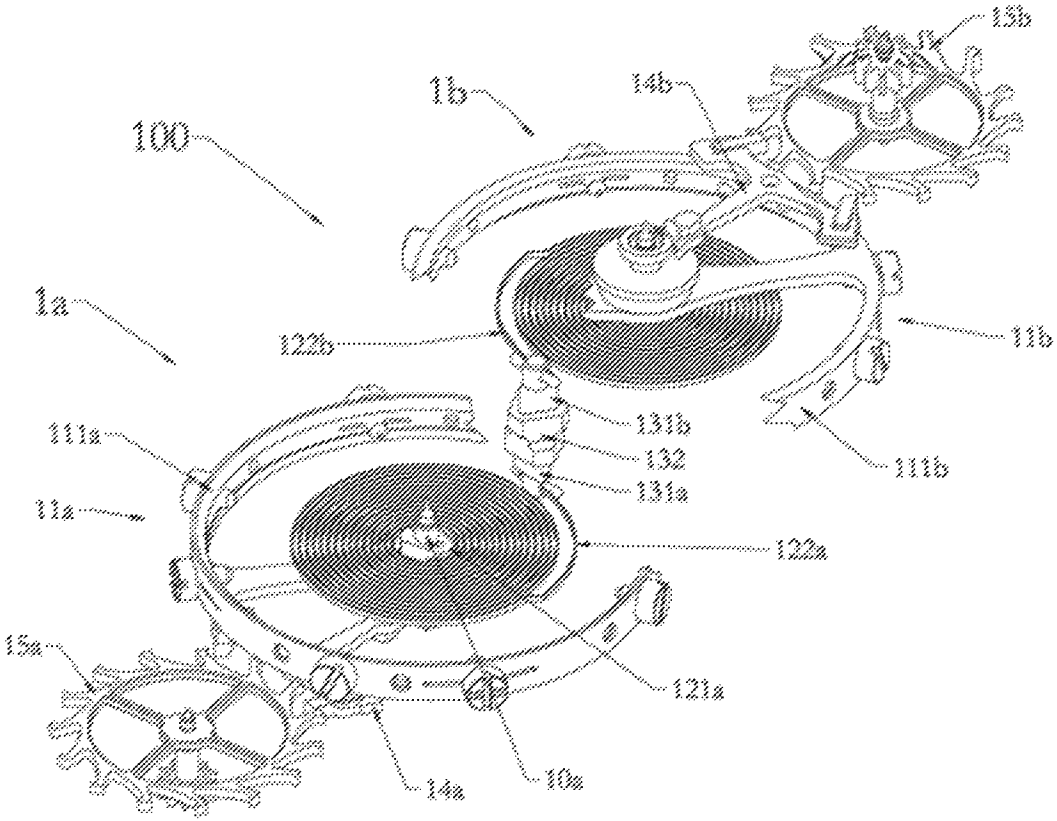

[Fig. 2]
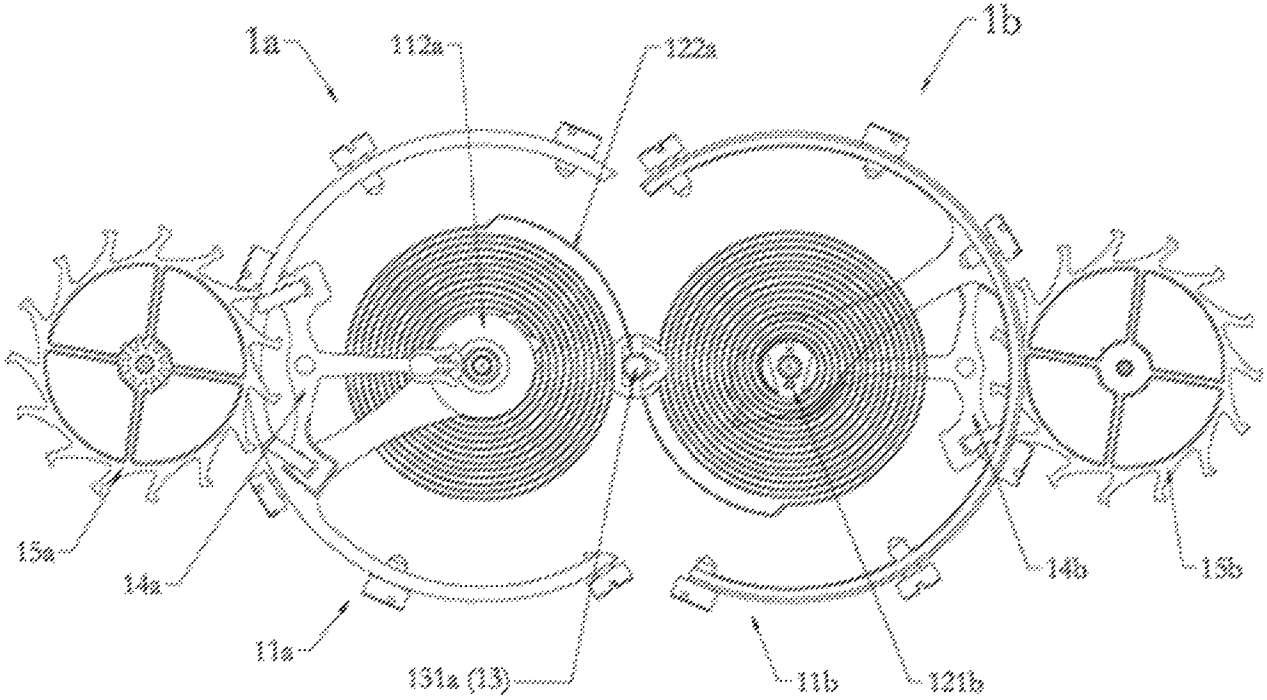

[Fig. 3]
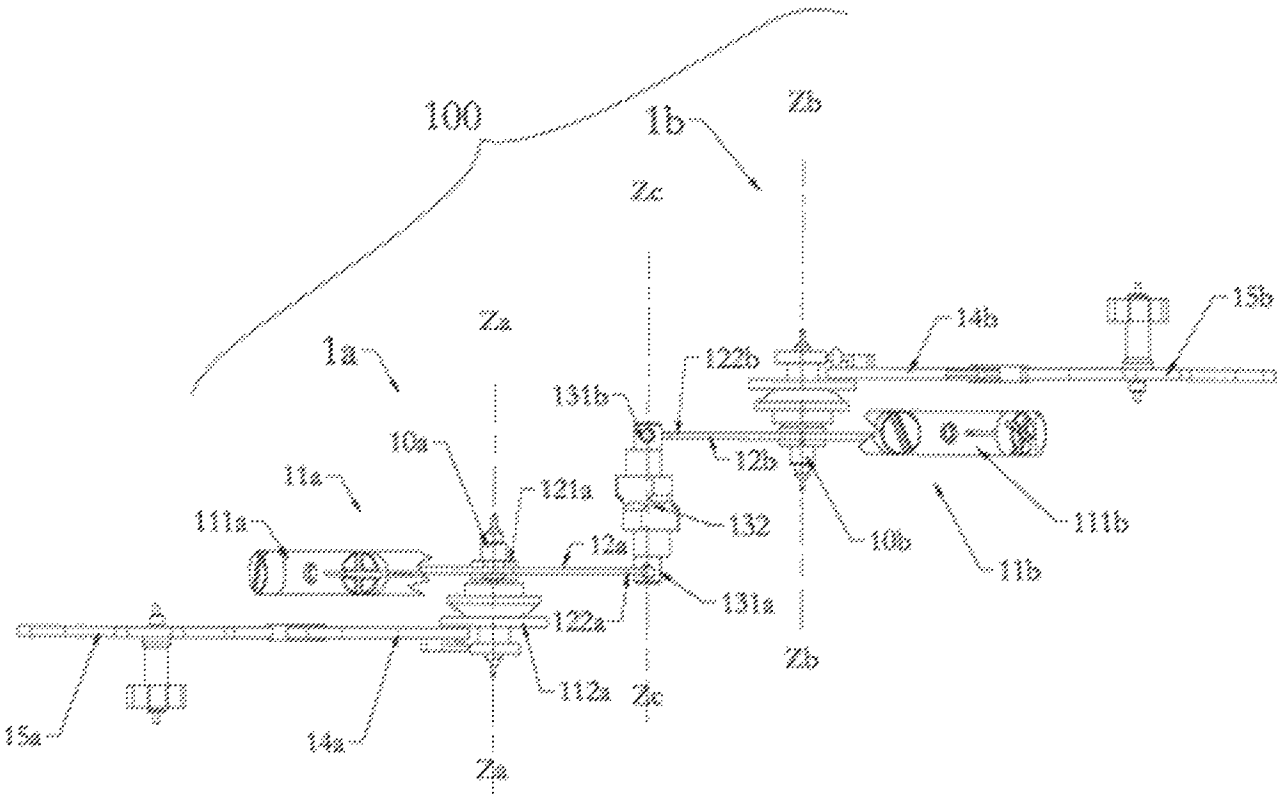

[Fig. 4A]
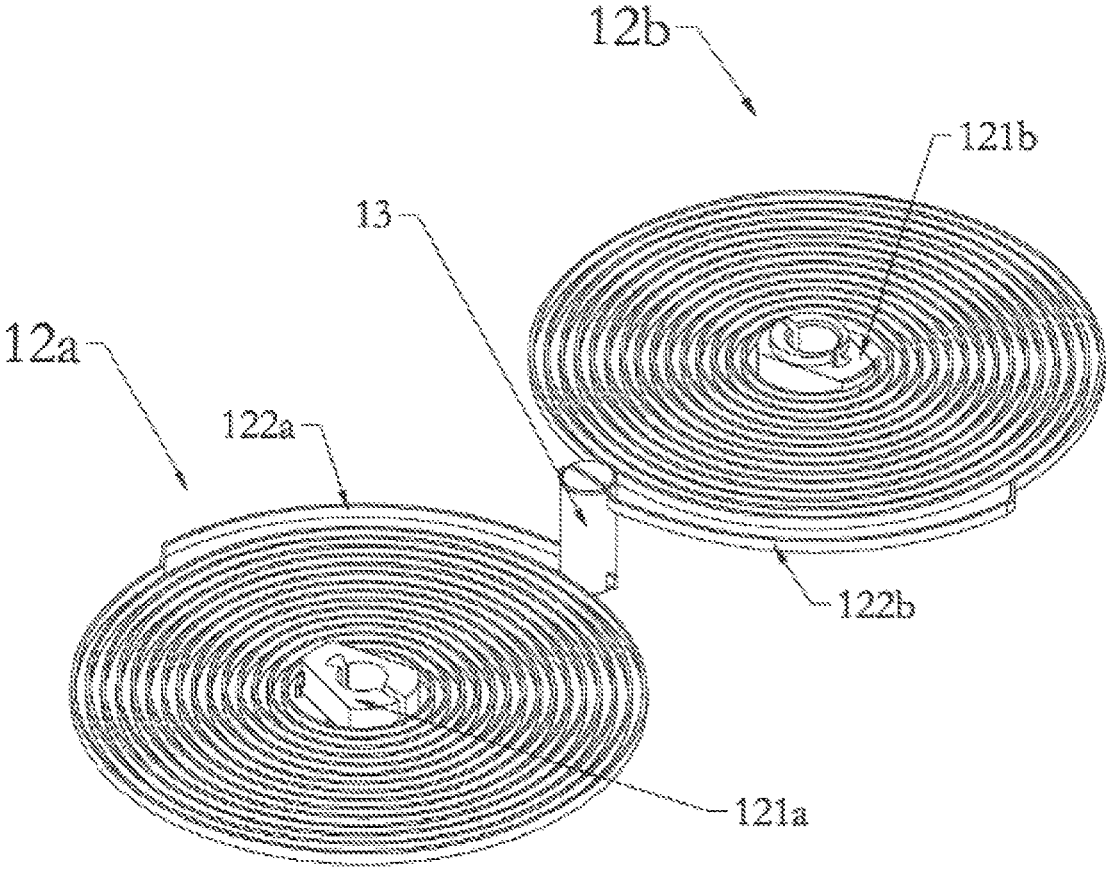

[Fig. 4B]
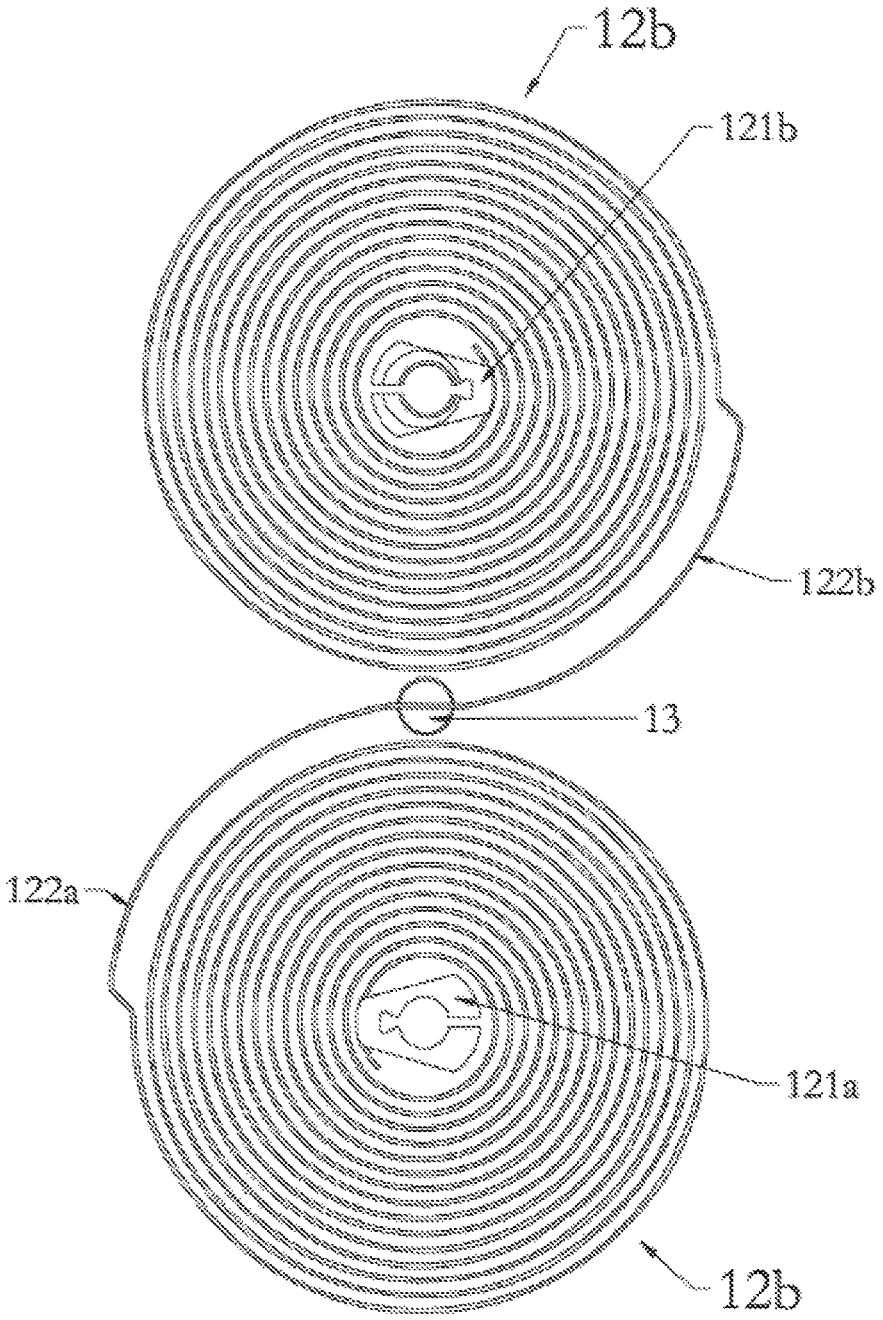

[Fig. 5A]
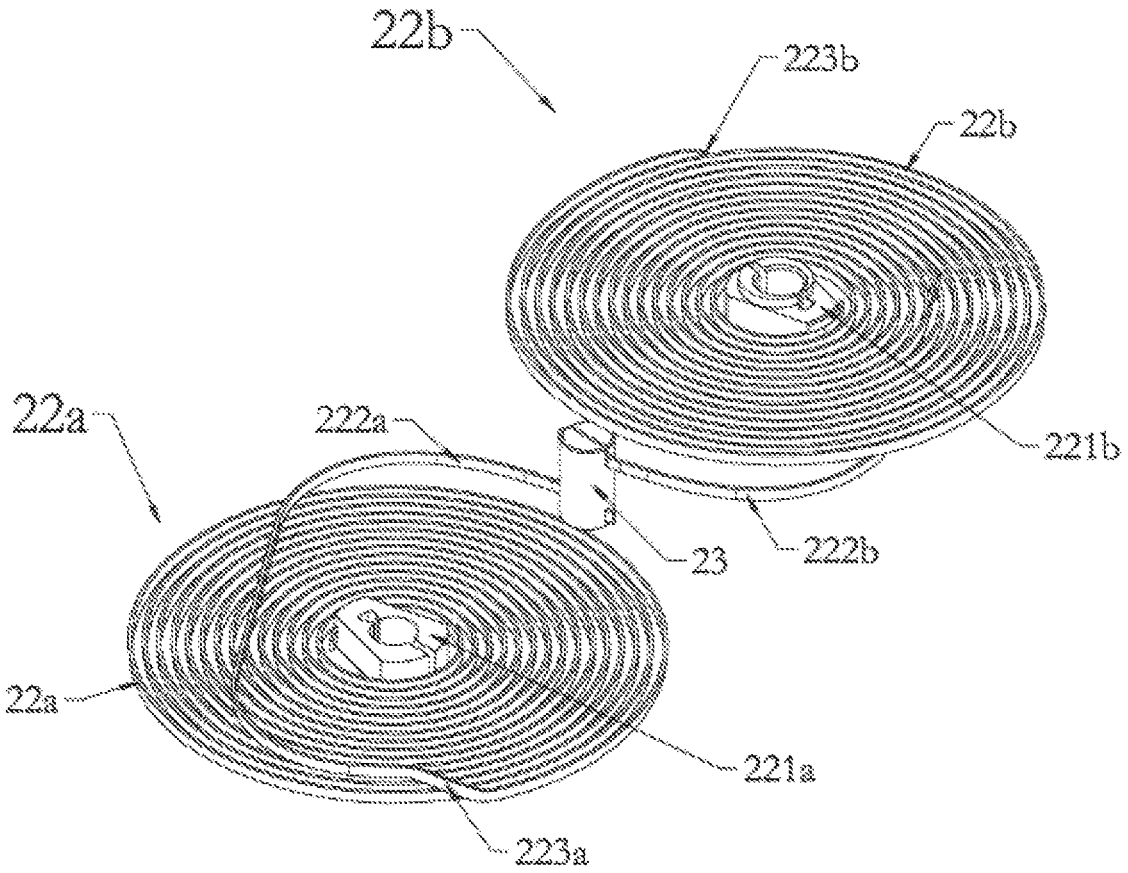

[Fig. 5B]
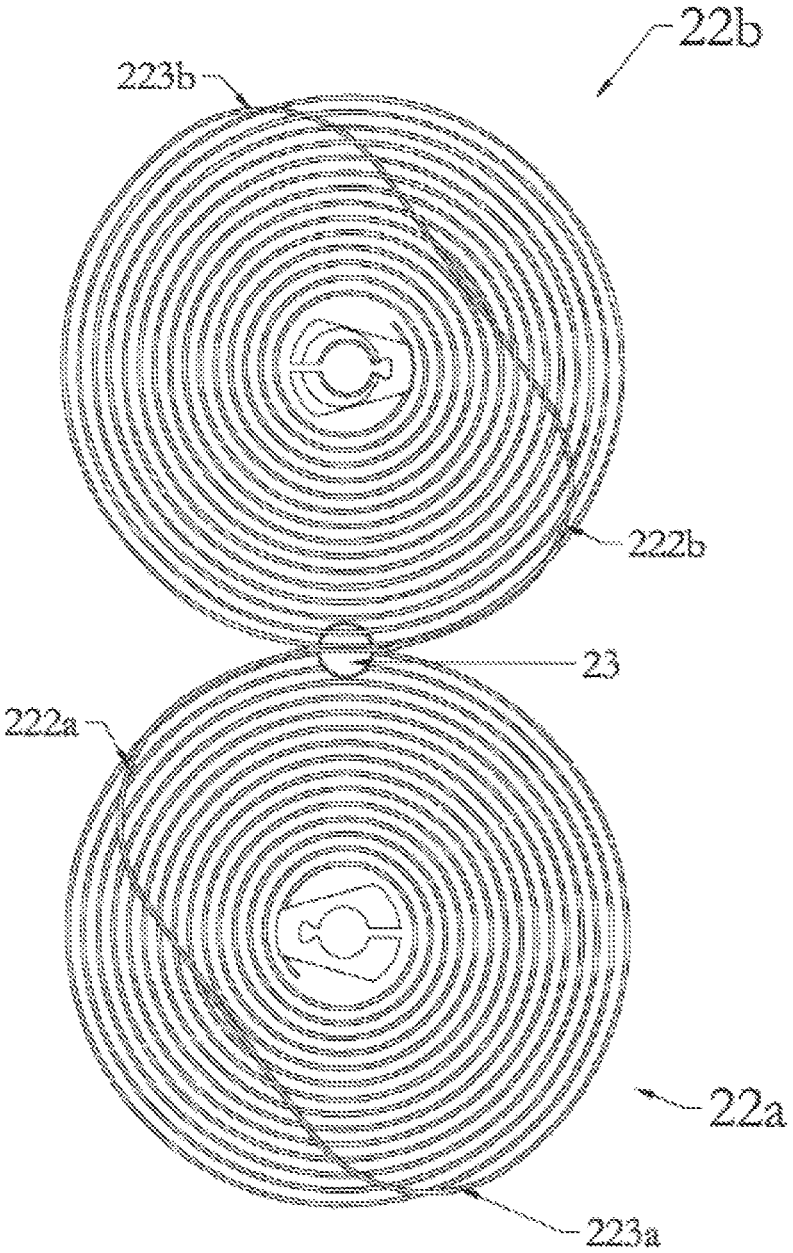

[Fig. 6]
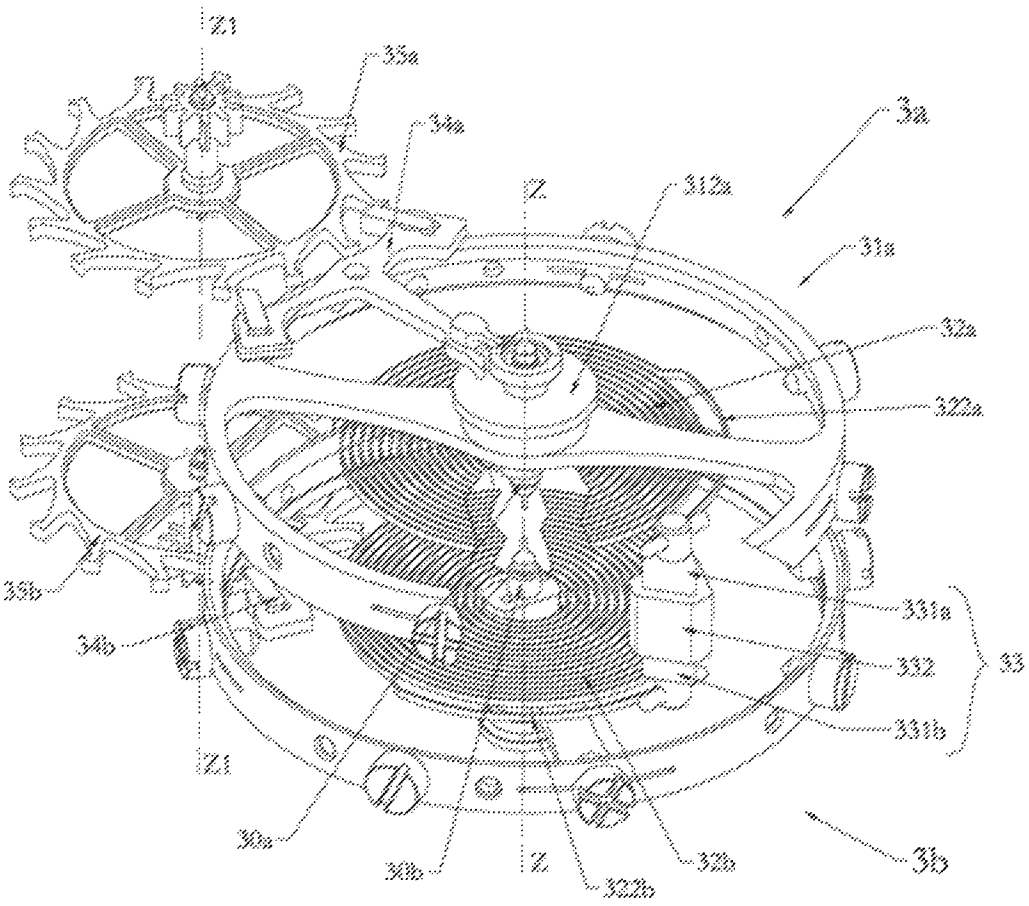

[Fig. 7]
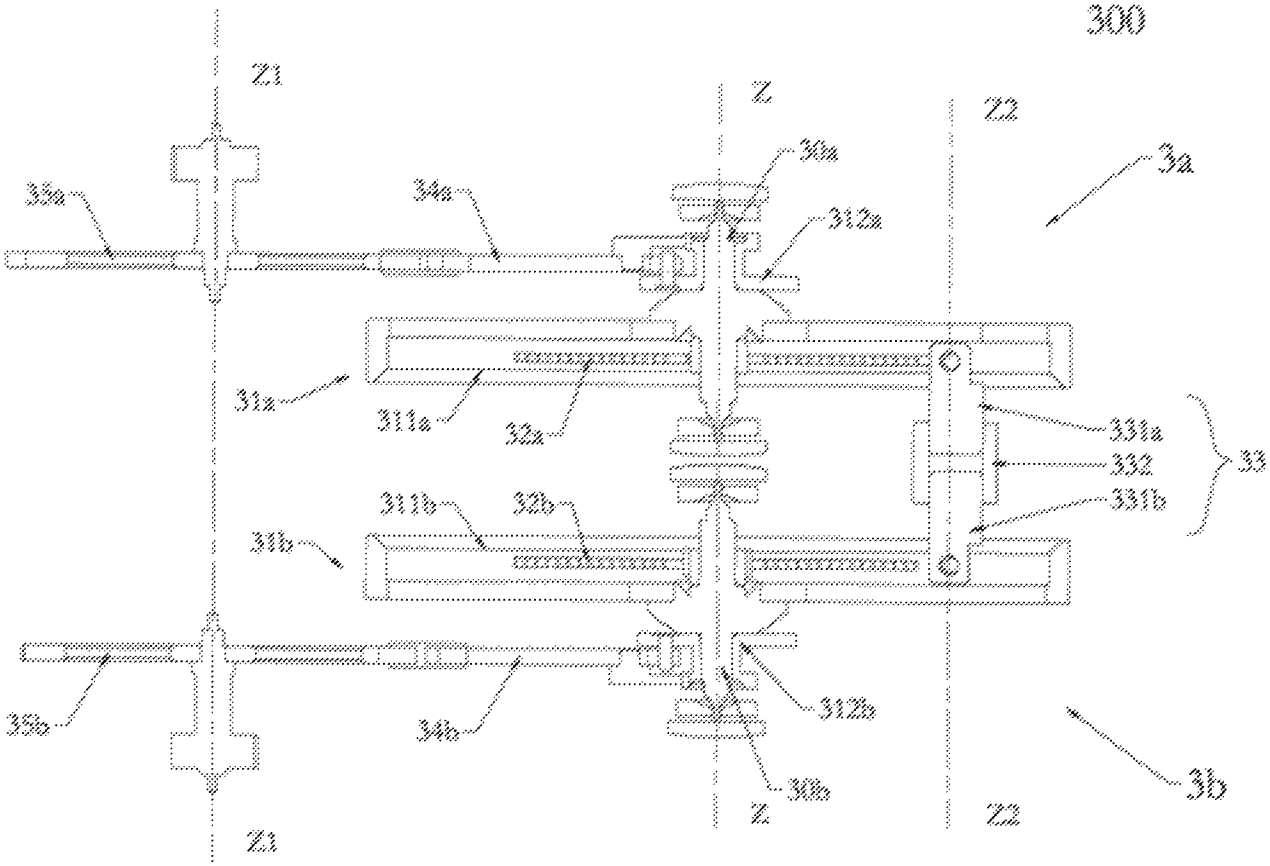

[Fig. 8A]
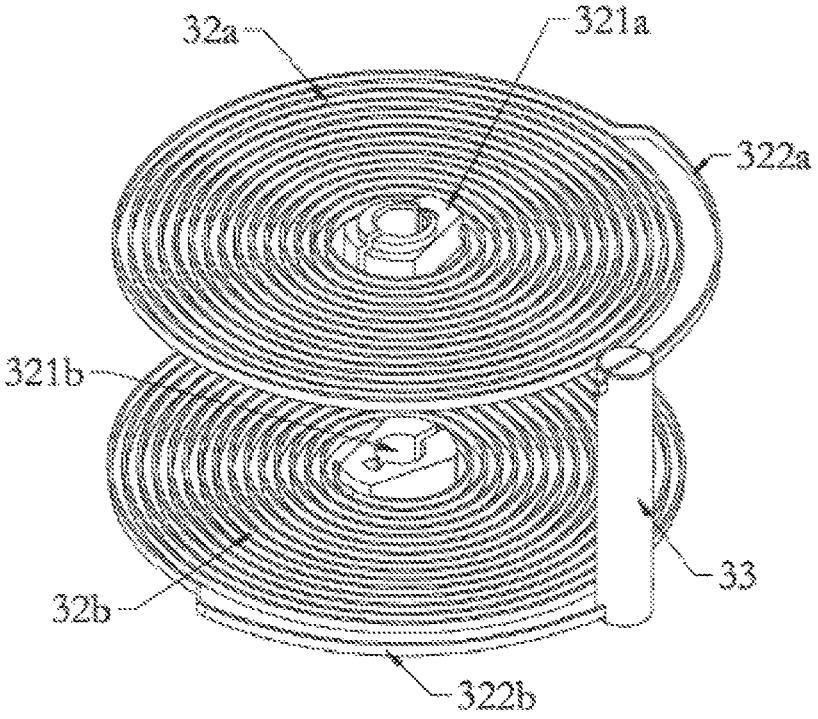

[Fig. 8B]
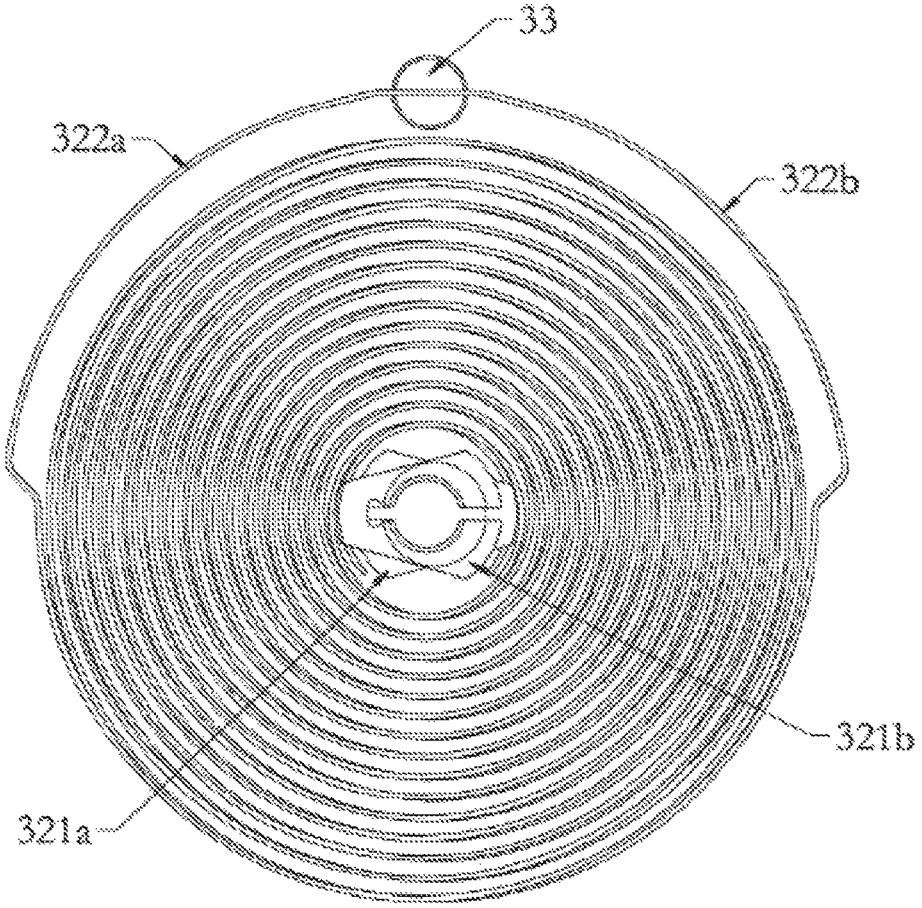

[Fig. 9]
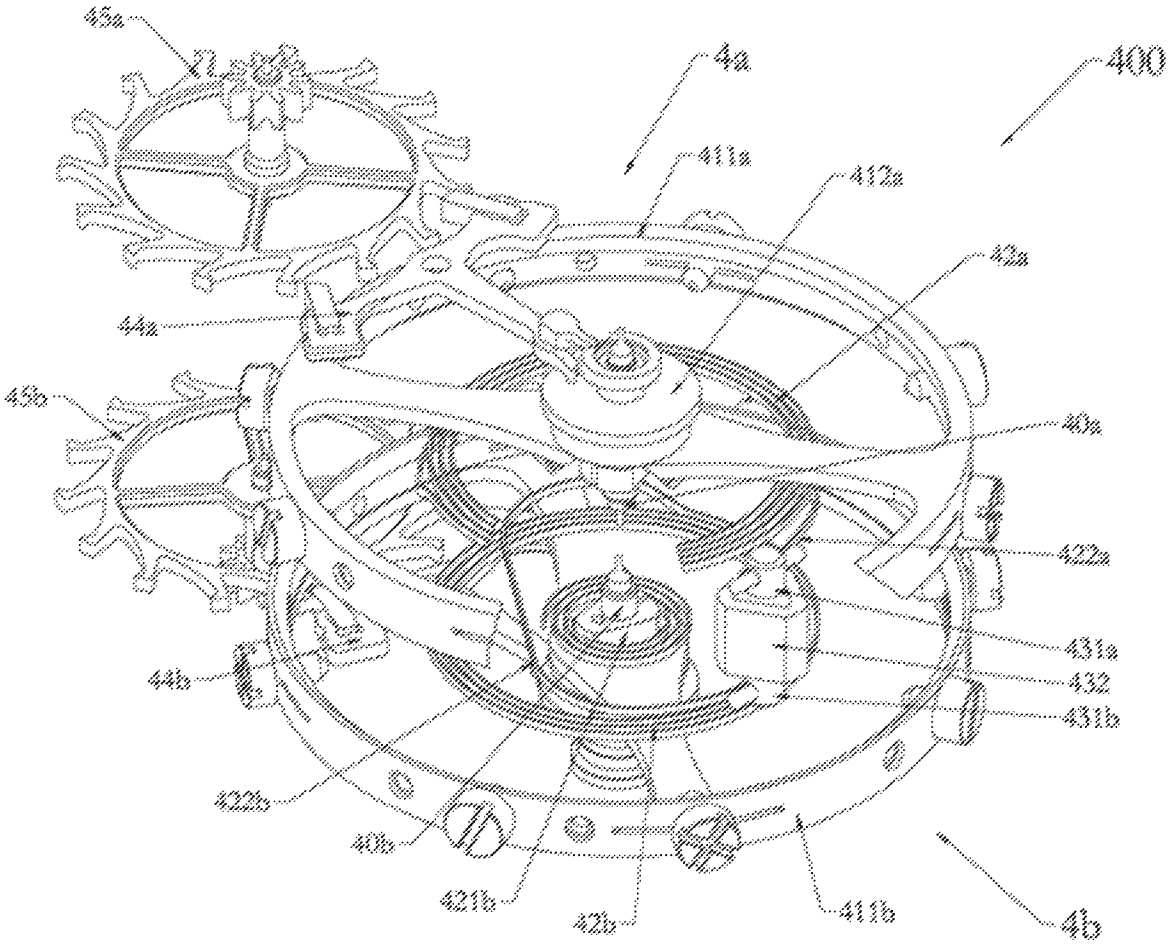

[Fig. 10]
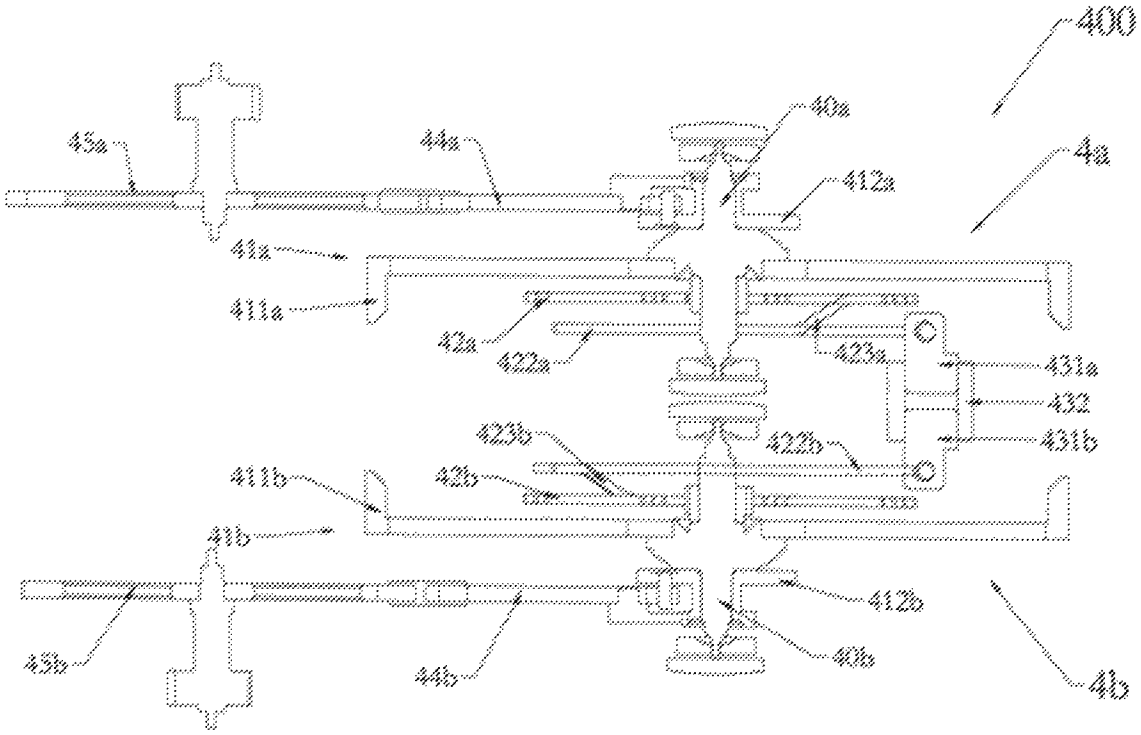

[Fig. 11A]
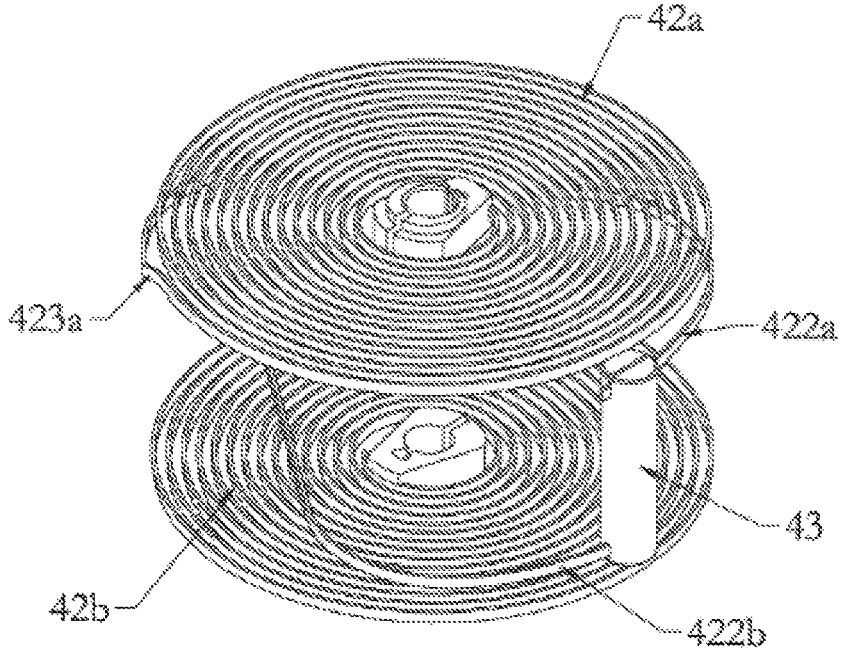

[Fig. 11B]
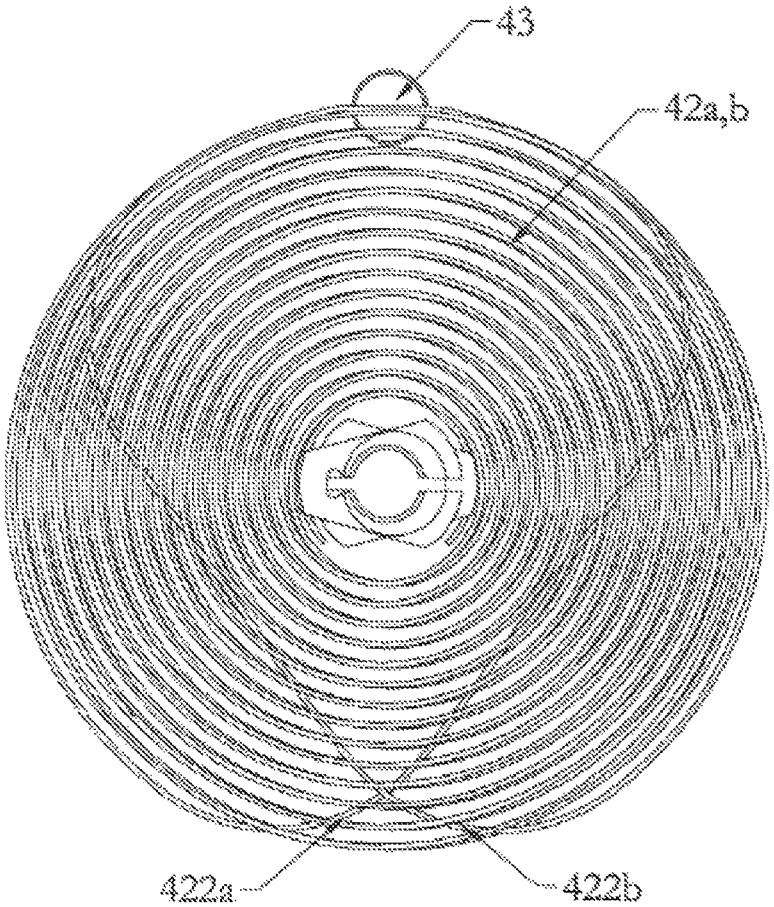

DEVICE FOR COUPLING TWO HOROLOGICAL OSCILLATORS

FIELD OF THE INVENTION

The present invention relates to a device for coupling two horological oscillators to ensure their synchronization.

STATE OF THE TECHNIQUE

Since Huygens' observation in the 17th century of the synchronization of two clocks, many attempts have been made to reproduce and explain the phenomenon. Although we might clearly understand the phenomenon of synchronization applied to clocks today, the same phenomenon applied to spiral-balances is not.

The fundamental principle of horological mechanisms is the regulation of time division. To do this, times regulated by oscillators that are intended to be as isochronous as possible.

Isochronism is the ability of an oscillator to oscillate at its resonant frequency regardless of its amplitude.

In the case of a clock, the resonance frequency depends on the length of the clock axle. The clock is isochronous for small amplitude oscillations.

In 1675 Huygens found a way of reduction in volume and broke free of the clock spiral-balance.

In the case of a spiral-balance oscillator, the resonance frequency depends on the inertia of the balance, the stiffness of the spiral spring and the active length of that spiral. In practice, the isochronism of the spiral-balance is greatly affected by position, temperature, escapement, etc. and requires compensation.

The reason for synchronizing two spiral-balance oscillators is to compensate for their isochronism defects related to dynamic balancing. If the two components oscillate perfectly symmetrically, one of the oscillators compensates for all symmetrical dynamic imbalances of the other oscillator. A system with two symmetrically synchronized oscillators will have a better isochronism than the two oscillators taken separately.

The first attempt to achieve synchronization of spiral-balance oscillators was made in 1810 by Breguet in his two-movement watch. The balances were side by side and extremely close together. At present it is not known exactly how Breguet intended to achieve synchronization.

Recent developments in wristwatches have involved bringing the balance rims closer to the annular balance wheels to create a coupling via the layer of air closest to the balance wheels.

Although some of the more advanced wristwatch mechanisms currently manufactured have two oscillators designed to synchronize together, none of the proposed solutions is really effective in ensuring isochronism and its stabilization over time.

SCOPE OF THE INVENTION

The present invention aims to develop a horological device comprising a group of two-by-two coupled spiral-balance oscillators allowing synchronization and improved isochronism to be achieved.

BRIEF AND ADVANTAGES OF THE INVENTION

For this purpose, this invention is aimed at a horological device composed of two oscillators with rotating and spiral balances, coupled together for their synchronization, this device being characterized in that the oscillators are identical and their axes parallel and the spirals are connected by their curved terminal to a shared stud attached to the rest of the horological movement.

This device according to the invention has the advantage of applying the difference in the forces exerted on the fixed shared stud. This difference is automatically established by the opposite mounting the terminal curves of the spirals on the shared stud. These studs are combined or associated in one piece to form the shared stud. This shared stud is connected to a fixed point in the movement.

The difference in the forces applied to the two curved terminals on the shared stud may correspond to tensile or thrust forces. This difference in forces has a direct effect on the stud, which in turn distributes it to the curved terminal curves of the spirals.

This direct transmission of the difference in forces equalizes the frequency of each oscillator very quickly, despite external and positioning disturbances.

According to another characteristic, the oscillators have either a flat or a Breguet spiral plane.

According to another characteristic, the shared stud is made of two integral studs, mounted head to tail, each receiving the end of the terminal curves of the two spirals. This allows direct transmission of the difference in the forces or pressures exerted by the spirals during their operation.

There is no functional difference between two studs combined with each other and a shared stud. The function is to generate a fixed point that joins one spiral to the other to achieve a balance of forces and thus the synchronization of the two oscillators.

Another advantageous feature is that the oscillators are arranged in such a way that the planes of the balances are parallel, their axes being in a common plane with the shared stud axis.

Another advantageous feature is that the two spirals are located inside the construction, between the two balances, so as to minimize the space between the spirals and maximize coupling efficiency. The escapes are therefore outside the space between the balances.

BRIEF DESCRIPTION OF THE ILLUSTRATIONS

This invention will be described in greater detail below by means of the design methods represented in the attached drawings, in which:

FIG. 1 is a perspective view of a first embodiment of a device with two oscillators with a rotary wheel balance oscillator and a spiral spring.

FIG. 2 is a bottom view of the device in FIG. 1

FIG. 3 is a sectional view of an axial plane of the device in FIG. 1

FIG. 4A is a detailed perspective view of the two spirals of the device in FIG. 1 attached to their shared stud.

FIG. 4B is a top view of the spirals and the shared stud of FIG. 4A.

FIG. 5A is a perspective view of Breguet's spirals in another embodiment of the device in FIG. 1.

FIG. 5B is a plan view of the two Breguet spirals in FIG. 5A

FIG. 6 is a perspective view of a third embodiment of a device with two coaxial oscillators.

FIG. 7 is an axial sectional view of the device in FIG. 6.

FIG. 8A is a perspective view of the two flat spirals in the device of FIG. 6.

FIG. 8B is a plan view of the two spirals in FIG. 8A.

FIG. 9 shows a fourth embodiment of the device with two coaxial oscillators, seen in perspective.

FIG. 10 is an axial sectional view of the device in FIG. 9.

FIG. 11A is a perspective view of Breguet's spirals in a fourth embodiment of the device.

FIG. 11B is a plan view of the two coaxial Breguet spirals in FIG. 11A.

DESCRIPTION OF AN EMBODIMENT

FIGS. 1, 2, 3 show a first method embodiment of the horological device 100. To simplify the presentation of the device, given the identity of the shapes and symmetries, one of the oscillators and its components will bear the numerical references supplemented by the suffix (a) and the other by the suffix (b). The representation is limited to the oscillators 1*a,b*, their anchor 14*a,b* and their escape wheel 15*a,b* which is connected to a gear train and mainspring not shown. The two oscillators 1*a,b* of device 100 are identical.

Each oscillator 1*a,b* consists of a balance wheel 11*a,b* with rim balance 111*a,b* and flat spiral 12*a,b* whose inner end is integral with a spiral collet 121*a,b* mounted on the axle 10*a,b* of the balance wheel 11*a,b*; its terminal curve 122*a,b* (i.e. its other end) is connected to a shared stud 13 integral with a non-detailed stud holder 132, itself fixed to the movement.

The conical portion of the balance wheel axle 10*a,b* which corresponds to the axle ZZa,b of the balance wheel 11*a,b* carries a double plateau 112*a,b* whose ellipse is in relation to the anchor 14*a,b* cooperating with the escape wheel 15*a,b*. This known part of the escape mechanism driving the oscillator 1*a,b* will not be described in more detail.

The two oscillators 1*a,b* are chiral, i.e. the balance wheel 11*a* and the spiral 12*a* and all their components are identical to the balance wheel 11*b* and the spiral 12*b* and all their components, to within the planar symmetry.

The axes (geometrical axes) ZZa,b of the two oscillators 1*a,b* are parallel. Both oscillators 1*a,b* are mounted so that they rotate in the same direction about their respective ZZa,b axis. This means that with respect to the same direction of the ZZa,b axes, both oscillators rotate in the same direction almost simultaneously. When the oscillators 1*a,b* are synchronized, they rotate in exactly the same direction at the same time.

The rotation of an oscillator 1*a,b* is the alternating movement of its balance wheel 11*a,b* driven by the anchor 14*a,b* in one direction and in the other, compressing then letting relax the spiral 12*a,b*.

The studs 131*a,b* to which the terminal curves 122*a,b* are connected are joined head to foot and for example joined together in a single piece called shared stud 13. The joining of the terminal curves 122*a,b* and the shared stud 13 is done in the same direction but in an opposite way so that the forces exerted by the spirals 12*a,b* on the shared stud 13 are opposite, i.e. the forces are aligned in the same direction but in opposite directions. Due to the symmetry of this mechanism, the direction of attachment of the ends of the terminal curves 122*a,b* to their studs 131*a,b* is in the plane not shown, perpendicular to the plane containing the ZZa,b axles and equidistant therefrom.

Oscillators 1*a,b* are in principle almost synchronous, so that the forces in the opposite direction applied to the shared stud 13 are of similar amplitude and opposite direction. The difference in amplitude of the forces due to their lack of synchronism is directly reflected from one terminal curve 122*a,b* to the other 122*b,a* via the shared stud 13 so that this difference decreases progressively until the oscillators 1*a,b* are synchronized.

The various parameters of the entire mechanism and external influences like gravity, the movements imparted to the mechanism and others, can disturb the oscillators which then resynchronize as described.

The average precision of a coupled balance wheel horological mechanism over a certain period of time improves as the synchronization or resynchronization is efficient and fast.

In more detail, the first embodiment of the device in FIGS. 1 to 3 comprises two oscillators 1*a,b* in parallel planes but offset in the direction of the axles ZZa,b to minimize the distance between the terminal curves of the two spirals. In this arrangement, according to the invention, the oscillators 1*a,b* are in a symmetrical plane with respect to each other. If we observe the mechanism along the axles ZZa,b the spirals 12*a,b* have the same winding, so that the spirals work in the same direction, so that the balance axles 11*a,b* rotate in the same direction at the same time. The same applies upstream for the escape wheels 15*a,b* and anchors 14*a,b*.

FIG. 2 shows in its bottom plan view, the interleaving of the volumes of the two oscillators 1*a,b* by the balance axle balance rims 111*a,b*. The balance rims 111*a,b* are shown partially cut to avoid complicating the drawing and for better perception of shared stud 13 and the opposite fastenings of the terminal curves 122*a,b*.

Since the two oscillators 1*a,b* are in separate planes one above the other, the balance rims 122*a,b* overlap as a projection but do not impede the movements of each other.

FIG. 3 is a simplified sectional view, without hatching, of the arrangement of FIGS. 1 and 2 showing the superposition of the two oscillators 1*a,b* and the intermediate arrangement of the shared stud 13. The axle ZZc of shared stud 13 is in the plane of the two axles ZZa,b of the oscillators 1*a,b*, parallel to and equidistant from the two axles ZZa,b.

FIGS. 4A,B show the spirals 12*a,b* of the two oscillators 1*a,b* and their shared stud 13 as well as the collet spirals 121*a,b*.

FIGS. 5A,B show another embodiment 200 of the mechanism with a device with two oscillators 2*a,b* like those 1*a,b* of FIG. 1 but with two Breguet spirals 22*a,b*. These spirals 22*a,b* differ from the flat spirals 12*a,b* of the first embodiment in that their terminal curve 222*a,b* is not in the plane of the spiral but in a parallel plane above this plane to join the shared stud 23. The terminal curve 222*a,b* joins this auxiliary plane by an inclined transition segment 223*a,b*.

The theoretical operation of this device is the same as that of device 100. All components that are identical to the previous ones are neither represented nor described.

The spirals 22*a,b* operate in the same direction by being, as in the embodiments of FIGS. 1 to 3, swiveled with respect to each other by 180° in their plane, if observation is along the axles ZZa,b; the terminal curves 222*a,b* passing respectively underneath and below the plane of their spiral 12*a,b* to reach their auxiliary plane and join the shared stud 23, in a median position between the two planes. This does not change the functional identity of the two spirals 22*a,b* and the oscillators 1*a,b*: the balance rims of the balance wheels turning in the same direction at the same time, just as the 22*a,b* spirals contract and expand at the same time.

The Breguet spirals 22*a,b* are brought together by comparison with the flat spirals; shared stud 23 is thus a plane projection, overlapped by the two spirals 22*a,b*.

FIGS. 6, 7, 8 A,B show an embodiment of device 300 in which the various components of device 300, identical to those of the previous embodiments, bear the same references as in FIGS. 1 to 3, where the first digit (3) replaces the digit (1).

The two oscillators 3*a,b* are coaxial on the ZZ axle. They comprise a balance wheel 31*a,b*, with rim balance 311*a,b* and flat spiral 32*a,b*, the inner end of which is integral with a spiral collet 321*a,b* mounted on the hub 30*a,b* of balance wheel 31*a,b*. Both oscillators and their escapes are geometrically identical.

Each terminal curve 322*a,b* is connected to a stud 331*a,b*. The two studs are head-to-tail and form a shared stud 33 connected to a 332*a,b* stud holder. The stud holder 332*a,b* is attached to the rest of the horological movement.

The two oscillators are arranged head-to-tail. If the system is viewed along the ZZ axle, the two spirals are wound in opposite directions.

In other words, the oscillators 3*a,b* are not symmetrical with respect to the mounting mid-plane, but antisymmetric since they rotate/oscillate in opposite directions.

The terminal curves 322*a,b* are connected to their studs 331*a,b* in the same direction but in the opposite way.

The two studs 331*a,b* form a shared stud 33 connected to a stud holder 332 whose connection with the rest of the mechanism is not shown.

In this assembly, as in the two previous assemblies, the compressive and tensile forces generated by the successive phases of compression and expansion of the spirals 32*a,b* are in the same direction but in opposite ways. The difference in the amplitudes of the forces applied to shared stud 33 is transmitted from one spiral to the other in order to gradually compensate for this difference in amplitude and achieve synchronization of the pair of oscillators.

The sectional view of FIG. 7 is in the shared plane containing the axles (ZZ), (Z1,Z1) and the axle (Z2,Z2) of shared stud 33.

This view shows the opposing arrangement of the two oscillators with respect to the median plane perpendicular to the (ZZ) axle (this plane is not shown). The terminal curve 322*b* in front of the intersecting plane is nor shown.

The dimensions of this device 300 in projection in the direction of axle (ZZ) are reduced since the escape wheels 35*a,b* are coaxial and their common axle (Z1Z1) is parallel to axle (ZZ).

The shared stud 33 has its axle (Z2Z2) located in the plane defined by axles (Z1Z1), (ZZ).

FIGS. 8A, 8B show in perspective and plan view the two flat spirals 32*a,b* and the terminal curves 322*a,b* connected to the shared stud 33 itself attached to the rest of the movement. These figures clearly show the operation in opposite directions of the two coaxial spirals 32*a,b*.

FIGS. 9, 10, 11B show a first method embodiment of the device 400. It differs from that of FIG. 6 in that the spirals 42*a,b* are Breguet spirals and not flat spirals. The other components are the same as before and their overall organization is identical so that all the elements identical or similar to those for example of the first embodiment according to FIGS. 1 to 3 bear the same references, the first digit (1) of which being replaced by the digit (4). The following description is limited to the differences related to the Breguet spiral 42*a,b*.

The antisymmetric coaxial arrangement of the oscillators 4*a,b* and the escape wheels 45*a,b* is retained.

A look along the ZZ axle reveals that the oscillators 4*a,b* with their balance wheel 41*a,b* and their spiral 42*a,b* rotate in opposite directions, generating forces in the same direction but in opposite directions applied to the shared stud 43. The difference in the amplitude of the forces is thus directly reflected from one spiral to the other by shared stud 43 to gradually achieve synchronization.

The terminal curves 422*a,b* of the Breguet spirals 42*a,b* leave the plane of their spiral to join another plane (auxiliary plane) parallel to the plane of their spiral. The sectional view in FIG. 10 shows more specifically the terminal curve 422*a,b* in the auxiliary plane above and below the spiral body to join the respective stud 431*a,b* (FIG. 10).

This arrangement is clearly shown in FIGS. 11A, 11B which show the single spirals connected to shared stud 43.

Thus the horological device according to the invention comprises two oscillators (1*a,b*) with rotating balance wheels (11*a,b*) and spiral balance wheels (12*a,b*), coupled for their synchronization and whose oscillators (1*a,b*) which are identical or identical to within a plane of symmetry, the axels (22*a,b*) of the oscillators 1*a,b* being parallel, the balance springs (12*a,b*) being connected by their terminal curves (122*a,b*) to a shared stud 13 by a connection in the same direction but in opposite ways and the shared stud (13) being fixed to the rest of the horological movement.

In this horological device the oscillators 1*a,b* comprise a plane spiral 11*a,b* or a Breguet spiral (21*a,b*).

The shared stud (13) comprises two studs (131*a,b*) which are joined together, mounted head-to-tail and each receiving the end of the terminal curves (122*a,b*) of a spiral (12*a,b*).

The oscillators (1*a,b*, 2*a,b*) are aligned in parallel planes, their axles (ZZa,b) being in a common plane with the axle (ZZc) of the shared stud (13), the escape wheels (15*a,b*) and the anchors (14*a,b*) being respectively above and below an oscillator (1*a,b*).

In this horological device the oscillators (3*a,b*, 4*a,b*) are superimposed in two parallel planes and the escape wheels (15*a,b*, 35*a,b*, 45*a,b*) are in planes parallel to those of the oscillators (3*a,b*, 4*a,b*), the axles of the escape wheels (15*a,b*, 35*a,b*, 45*a,b*) are coaxial and the shared stud (33, 43) is located between the two oscillators in the middle position.

PARTS LIST OF MAIN COMPONENTS

Without the Suffixes a and b

| | | | | |
|---|---|---|---|---|
| 400 | 300 | | 100 | Horological device |
| 4 | 3 | 2 | 1 | Oscillator |
| 40 | 30 | | 10 | Balance axle |
| 41 | 31 | | 11 | Balance wheel |
| 411 | 311 | | 111 | Balance rim |
| 412 | 312 | | 112 | Double plateau |
| 42 | 32 | 22 | 12 | Spiral |
| 421 | 321 | 221 | 121 | Spiral collet |
| 422 | 322 | 222 | 122 | Terminal curve |
| 43 | 33 | 23 | 13 | Shared stud/anchor |
| 431 | 331 | | 131 | Stud |
| 432 | 332 | | 132 | Stud holder |
| 44 | 34 | | 14 | Anchor |
| 45 | 35 | | 15 | Escape wheel |

To simplify the presentation of the claims, not all similar references are systematically included in the claims. They are shown only if necessary for understanding.

The invention claimed is:

1. A horological device comprising two oscillators with rotating and spiral balance wheels, coupled for their synchronization, characterized in that the two oscillators are identical or identical to within a plane of symmetry;

axes of the two oscillators are parallel;

the spirals each have a terminal curve, and the spirals being connected by the terminal curves being connected to a shared stud by a connection in a same direction but in an opposite way; and the shared stud is attached to a rest of the horological movement, where the shared stud is a fixed point which joins the spirals, where the shared stud being the fixed point is relative to the rest of the horological movement.

2. A horological device comprising two oscillators with rotating and spiral balance wheels, coupled for their synchronization, characterized in that the two oscillators are identical or identical to within a plane of symmetry;

axes of the two oscillators are parallel;

the spirals each have a terminal curve, and the spirals being connected by the terminal curves being connected to a shared stud by a connection in a same direction but in an opposite way; and the shared stud is attached to a rest of the horological movement;

characterized in that the shared stud comprises two studs mounted together, each receiving an end of the terminal curve of a respective one of the spirals.

3. A horological device comprising two oscillators with rotating and spiral balance wheels, coupled for their synchronization, characterized in that the two oscillators are identical or identical to within a plane of symmetry;

axes of the two oscillators are parallel;

the spirals each have a terminal curve, and the spirals being connected by the terminal curves being connected to a shared stud by a connection in a same direction but in an opposite way; and the shared stud is attached to a rest of the horological movement;

characterized in that the two oscillators are aligned in parallel planes, axes of the two oscillators being in a common plane with an axis of the shared stud, an escape wheel and an anchor being above one of the two oscillators, and another escape wheel and another anchor being below another one of the two oscillators.

4. The horological device according to claim 1, characterized in that the axes of the two oscillators are different axes.

* * * * *